US007861317B2

(12) United States Patent
Beliveau

(10) Patent No.: US 7,861,317 B2
(45) Date of Patent: Jan. 4, 2011

(54) NOSE COVER

(76) Inventor: Robert Beliveau, 384 S. Miraleste Dr. #465, San Pedro, CA (US) 90732

( * ) Notice: Subject to any disclaimer, the term of this patent is extended or adjusted under 35 U.S.C. 154(b) by 1411 days.

(21) Appl. No.: 10/962,874

(22) Filed: Oct. 8, 2004

(65) Prior Publication Data

US 2007/0250976 A1 Nov. 1, 2007

(51) Int. Cl.
*A41D 13/00* (2006.01)

(52) U.S. Cl. ..... 2/9

(58) Field of Classification Search ..... 2/9, 2/12, 13, 446; 128/858; 351/65, 69, 76, 351/78, 79, 80, 81, 87, 88, 132, 136, 137, 351/138, 139, 142; D29/105, 106, 108
See application file for complete search history.

(56) References Cited

U.S. PATENT DOCUMENTS 3,835,848 A * 9/1974 Berner ..... 606/204.45
4,274,402 A * 6/1981 Shippert ..... 602/17
5,022,389 A * 6/1991 Brennan ..... 606/204.45
5,274,847 A * 1/1994 Lauttamus ..... 2/9
5,416,923 A * 5/1995 Peugh ..... 2/9
D374,507 S * 10/1996 Beliveau ..... D29/108
5,717,992 A * 2/1998 Tilghman ..... 2/9
5,947,123 A * 9/1999 Shippert ..... 128/858
6,206,902 B1 * 3/2001 Morikane ..... 606/204.15
6,299,605 B1 * 10/2001 Ishida ..... 604/289
6,649,181 B1 * 11/2003 Miner ..... 424/402
D536,139 S * 1/2007 Beliveau ..... D29/108

* cited by examiner

*Primary Examiner*—Gary L Welch
*Assistant Examiner*—Alissa J Tompkins

(57) ABSTRACT

A nose cover or nose protector, for adventurers, sports fans, and people who love outdoor activities, comprises a nose piece formed from sheets of paper, plastic, fabric, foam, laminated materials, pressure heat cut and seal materials, and/or die-cut materials to fit and cover the nose. Additional materials of adhesive pieces and soft metal sheets are used to fold and contour the nose cover onto the wearer's nose. A corresponding "hook and loop" strap or "hook" patch is used to connect the nose cover to the bridge of eyewear. This nose cover can also consist of heat packs, cold packs, and/or medicated packs to comfort the user. The nose cover can be used with or without eyewear, and with variety of optional accessories.

9 Claims, 11 Drawing Sheets

A

B

A

B

NOSE COVER

CROSS-REFERENCE TO RELATED APPLICATION(S)

This application claim the benefit of priority from pending U.S. Provisional Patent Application No. 60/509,395, entitled "Nose Cover," filed Oct. 7, 2003, and U.S. Design Patent No. D29/374,507, "Nose Protector," granted Oct. 8, 1996, which are both herein incorporated by reference in their entirety.

BACKGROUND OF THE INVENTION

1. Field of Invention

This invention relates to the field of nose covers.

Portions of the disclosure of this patent document contain material that is subject to copyright protection. The copyright owner has no objection to the facsimile reproduction by anyone of the patent document or the patent disclosure as it appears in the Patent and Trademark Office or records, but otherwise reserves all rights whatsoever.

2. Background Art

The incidence of skin cancer is increasing rapidly, primarily because of increase recreational exposure to ultraviolet (UV) light and increased longevity. Lack of nose protection options prevent people with skin cancer of the nose enjoy outdoor activities.

The most common concern from outdoor activities is the exposure of the skin to sunburn or frost. However, currently there are only few types of nose shields in the market. Most of these nose shields are pre-attached to a set of goggles and, thus, leave no options to the wearer but use the whole gadget. Often these nose shields are tough, heavy, uncomfortable, and/or difficult to use. Additionally, these nose covers, which are typically made of vinyl, aluminum, or some sort of other solid material that is not breathable, will result in a sweaty nose. Some of these inventions come with self-adhesive backings too. But, a wet nose from sweat will result in adhesive not to stick to the wet skin. Furthermore, these nose shields are only good for sun protection. Thus, there is a need for an alternative nose cover protector.

SUMMARY OF THE INVENTION

The present invention overcomes this problem by using breathable and flexible layered material for the nose cover, which provides convenient nose protection. This invention consists of multiple embodiments. These embodiments include, but are not limited to, a nose protector made out of a disposable perforated paper; a nose protector which contains a silicone lining; a nose protector containing a hot pack(s) and/or cold pack(s) for adverse temperatures; and a nose protector comprising of a stretchable fabric cover which would encompass the nose cover like a glove on a hand. The stretchable fabric cover will form a pocket that allows for items to be inserted. For example, multiple hot or cold packs could be placed inside the pocket. The pocket would allow for the packs to be easily replaced. In another embodiment, a nose protector could be formed using foam laminated materials. These laminated materials could have a logo embossed onto them and could secure a hot or cold pack as well along with wicking type fabrics. In another embodiment, a nose protector could have a strap which would enable it to attach to eyewear easily. For example, the strap could be made out of "hook and loop" material, which is also known as velcro. In an another embodiment, an aluminum strip could be attached to front portion of the nose cover that would allow for the nose cover to pinch securely onto the nose. Also, in another embodiment, the nose cover could contain velcro compatible fabrics or adhesive pads that are able to attach to eyeglass nose rests to secure the nose cover. In an alternative embodiment, the nose cover could have an adhesive patch on its underside that directly adheres to the nose.

ADVANTAGES

Accordingly, besides the advantages of the nose cover described above, there are other additional advantages of the present invention. One advantage is that it provides nose protection for all types of weather without sweaty results. Another advantage is that the wearer of the nose shield has options of materials that it is fabricated out of. For example, some of these options include perforated paper or plastic, foam laminated fabric, wire mesh laminated fabrics, fabric with an aluminum strip, fabric with an adhesive-lining, and/or fabric with a "hook and loop" strap attachment.

Additionally, another advantage is to provide a nose cover with different kinds of linings, which may or may not have adhesive, and may or may not have "hook" velcro compatible properties. For example, an adhesive lining can be fabricated out of a foam pad adhesive, a thin adhesive strip, or silicone which will be able to re-stick to the nose. The comfortable fabric lining may be velcro compatible to secure a replaceable hot or cold pack with "hook and loop" velcro compatibility.

An additional advantage of the present invention is to provide for a cheap, disposable nose protector that is light weight, breathable, convenient, and easy to use. For example, the disposable perforated nose cover could have logos on it so that it could be used for marketing purposes. These nose covers could be inserted in a magazine, program, or simply handed out at events and would incorporate a four color printing technology called sublimation.

Another advantage of the present invention is to provide a fashionable nose cover that can be produced in a variety of colors, styles, and sizes, while still providing comfort. The templates or the outline of the nose cover are designed in such a way that it not only efficiently covers all types of noses, but so that the nose cover won't flip up in high winds or during high speed activities. The creases and/or wedge cuts located at both the top and bottom portions of the template fit the contours of the nose in such a way that it creates a slight arch that best hugs the nose's curves at both the bridge and the tip of the nose. This not only keeps the nose cover from flipping up but it also helps secure the fit of the eyewear. Further more, the metal properties of the nose cover also give the nose cover memory or substance that allows the wearer to form the product most effectively to all types of noses. This also helps keep eyewear in place, so that the eyewear and nose cover won't slip down on the nose.

Other advantages include to provide a nose protector that can be used with or without sunglasses or ski goggles. The embodiments of the nose cover each have special features for satisfying nose protection. The nose cover may be worn both with and without eyewear and may or may not include a strap or adhesive properties for a secure fit.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

The embodiments of the present invention are directed to a method and an apparatus for covering the nose. In the following description, numerous details are set forth in order to provide a more thorough description of the present invention. It will be apparent, however, to one skilled in the art, that the present invention may be practiced without these specific details. In other instances, will known features have not been described in detail so as not to unnecessarily obscure the present invention.

The present invention consists of a cover that is formed in the shape of a nose that protects the nose from harsh environmental elements. The cover can be manufactured in various materials. Also, the cover can be attached to the nose, glasses, goggles, or other eyewear in a variety of ways. As shown, the nose cover has a pentagonal body, resembling an upside-down pentagon, having rounded corners. The top portion of the nose cover is substantially flat and sized to conform around the bridge of the nose. The bottom portion of the nose cover is a rounded corner or hyperbolic-shape configured to rest on top of the bridge of the nose.

Figure 1A:
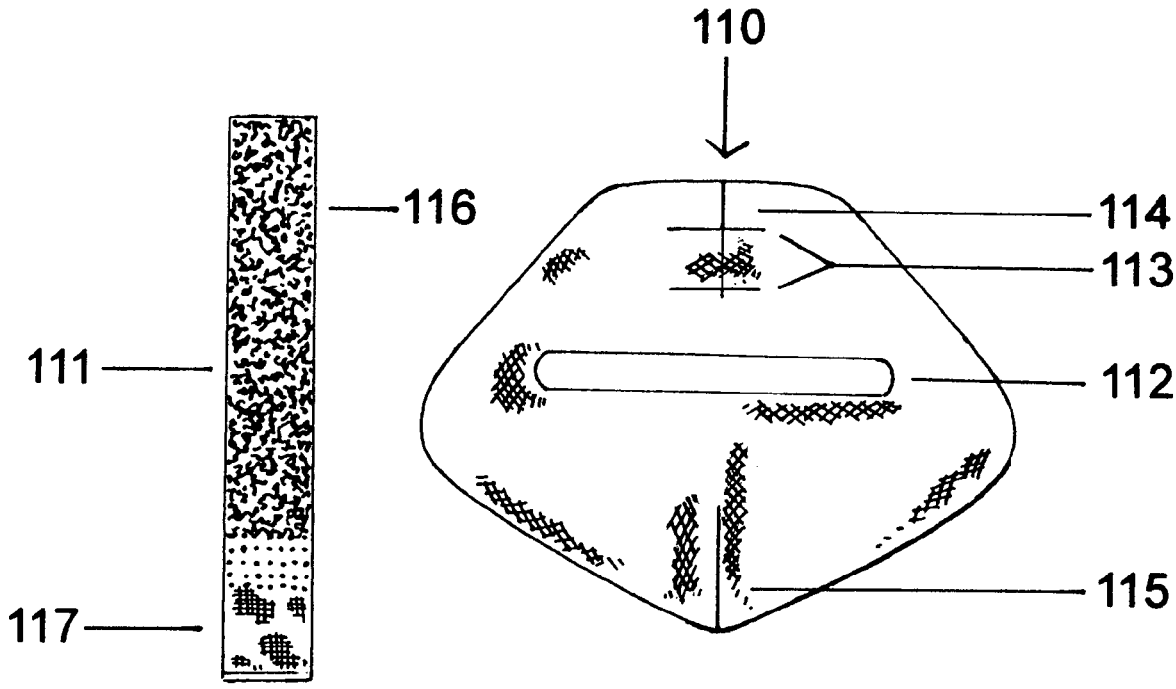
FIG. 1A illustrates a top view of nose with a removable strap.

FIG. 1A depicts the top view of a nose cover 110 with a removable strap 111 in one embodiment of the invention. The removable strap 111 allows for the nose cover 110 to be attached to all sorts of eyewear. The nose cover 110 comprises a flexible material with vertical creases (upper 114 and lower 115), two horizontal slits 113, and an attached soft metal strip 112. In this embodiment, the removable strap can be made out of "hook and loop" material, also known as velcro. Also, in this embodiment, the nose cover 110 can be fabricated in many different materials. For example, some materials include laminated foam fabric, fleece, paper, plastic, metal, thermal conductive materials (e.g., hot and/or cold pack), and laminated wire mesh. When using laminated foam fabric, the edges of the nose cover may be heat sealed, and/or the foam fabric itself may embossed, printed, silkscreened, or sublimated with a logo of some sort.

In FIG. 1A, the top portion of the strap 111 comprises "loop" fabric 116 and the lower portion of the strap comprises "hook" fabric 117. The removable strap 111 is to be inserted in the two horizontal slits 113. Once the removable strap 111 is inserted, the strap 111 is to be wrapped around the bridge of any eyewear. The nose cover 110 is secured to the eyewear by fastening the "loop" portion 116 of the removable strap 111 to the "hook" portion of the strap. The upper vertical crease 114 and the lower vertical crease 115 allow the nose cover 110 to bend around the contours of the nose. The metal strip 112 can be fastened to the nose cover 110 in a variety of ways. The metal strip 112 can be pinched onto the nose by the user, which allows for the nose cover 110 to fit more securely onto the nose.

Figure 1B:
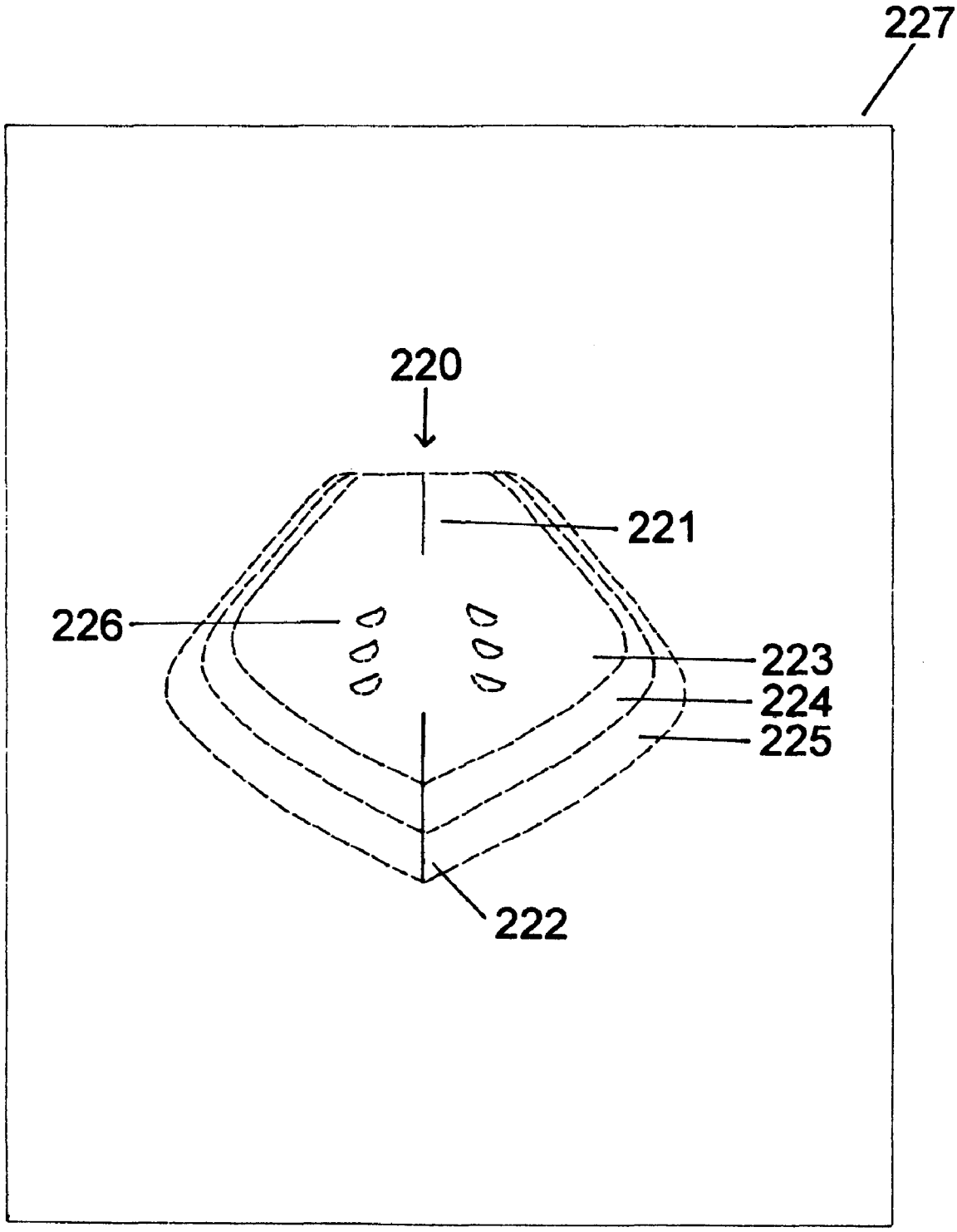
FIG. 1B illustrates a top view of nose cover that is on a perforated sheet.

FIG. 1B illustrates another embodiment of a nose cover 220 that is on a perforated sheet 227. The perforation allows the nose over 220 to be available in a variety of sizes for the user. Also, the perforated sheet 227 is convenient for advertising and can be implemented by inserting it inside of a magazine. There is a wide variety of materials that nose cover 220 can be fabricated from. For example, some materials include laminated foam fabric, paper, and plastic. The nose cover 220 size can be selected by tearing the perforations at the user's preferred size. For example, if the user wants a small size nose cover 220, he will tear perforation 223. Or, if the user wants a medium size nose cover 220, he will tear perforation 224. Similarly, if the user wants a large size nose cover 220, he will tear perforation 225. The top surface area of the nose cover 220 can have multiple air vent perforations 226 that can be lifted from the sheet. Also, the nose cover 220 can have vertical creases and or reattached/sewn wedge cuts (upper crease 221 and lower crease 222) which allow for the cover to be bend around the contours of the nose.

Figure 1C:
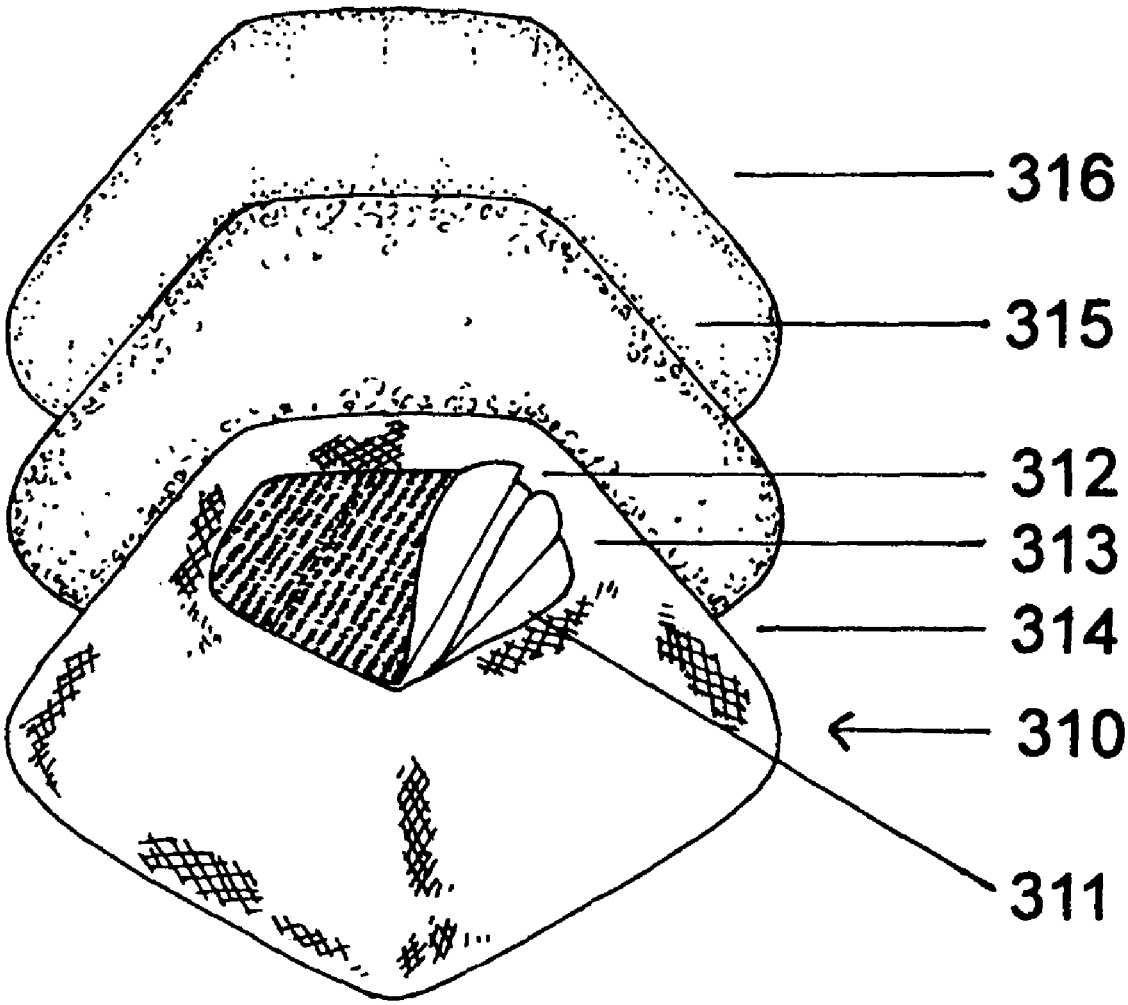
FIG. 1C illustrates a top view of a nose cover which has a metal patch embedded inside it.

FIG. 1C depicts another embodiment of a nose cover 310 that contains a metal patch 313 that is embedded inside. The metal patch 313 allows for the nose cover 310 to be securely fitted onto the nose. In order for the nose cover 310 to be secured onto the nose, the user simply pinches the metal patch to the nose's contours. The metal patch 313 lies in a cavity 311 of the top layer 314 of the nose cover 310. The hook patch 312 covers metal patch 313.

In FIG. 1C, the nose cover 310 can be secured to eyewear by the hook patch 312 that is fabricated from "hook" velcro. Since the hook patch 312 is made from "hook" velcro, it can be fastened to "loop" velcro that is attached to the eyewear. Nose cover 310 consists of three layers (top layer 314, middle layer 315, and bottom layer 314). There is a provision of choices of materials that nose cover 310 can be fabricated from. For example, layers 314, 315, and 316 can be made from polyester, foam, and nylon, respectively.

Figure 2:
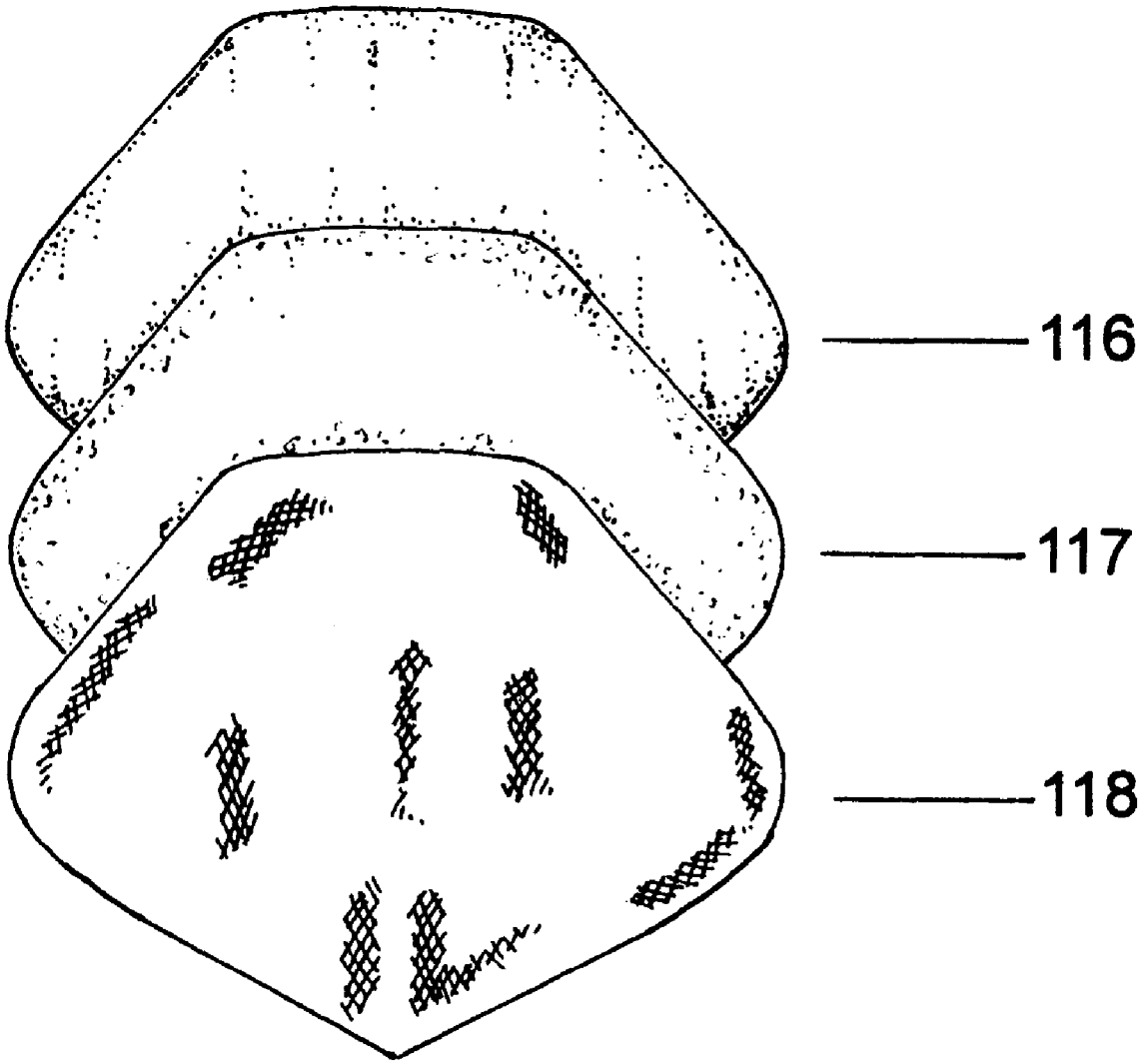
FIG. 2 illustrates the layers of a nose cover.

FIG. 2 also illustrates the layers of a nose cover. In one embodiment, the nose cover can contain multiple layers. In FIG. 2, for example, the nose cover comprises three layers (top layer 118, middle layer 117, and bottom layer 116). The layers 118, 117, and 116 can be made of a wide variety of materials. Some materials include polyester, foam, nylon, metal, wire mesh, plastic, and paper.

Figure 3:
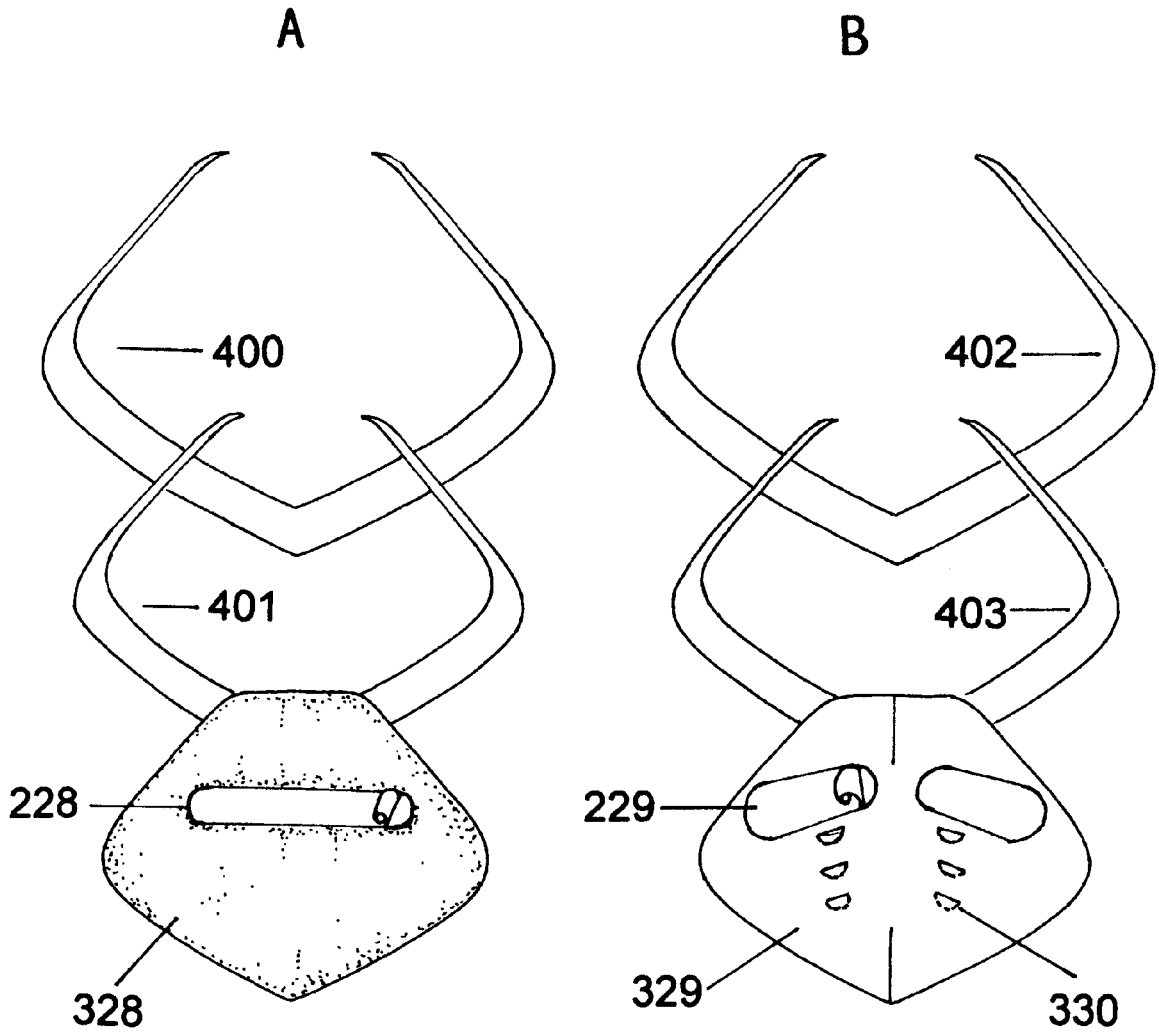
FIG. 3 illustrates the underside of two nose covers that each have adhesive patches.

FIG. 3 depicts another embodiment of the present invention. In FIG. 3, the underside of two nose covers that each have adhesive patches is illustrated. Nose cover 328 has adhesive patch 228 on its underside that allows for the nose cover 328 to adhere to the user's nose. In FIG. 3, materials 400 and 401 illustrate the discarded perforation materials if the user chose to tear out the small sized nose cover 328.

Similarly, in FIG. 3, nose cover 329 has adhesive patch 229 on its underside that allows for the nose cover 329 to adhere to the user's nose. Also, nose cover 329 has air vent perforations 330 that allow for air flow. Also, in FIG. 3, materials 402 and 403 illustrate the discarded perforation materials if the user chose to tear out the small sized nose cover 329.

Figure 4:
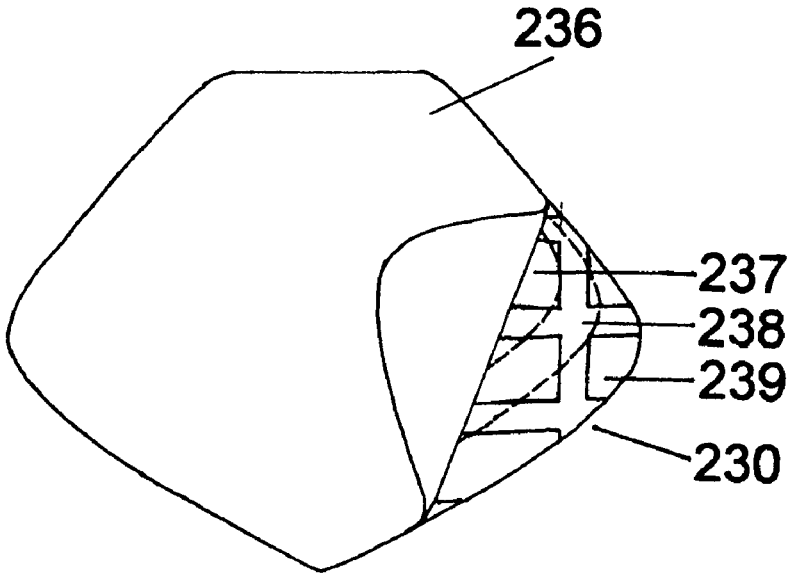
FIG. 4A illustrates the underside of a nose cover that has a hot or cold pack.
FIG. 4B illustrates the underside of a nose cover that has a silicone adhesive.
Figure 4:
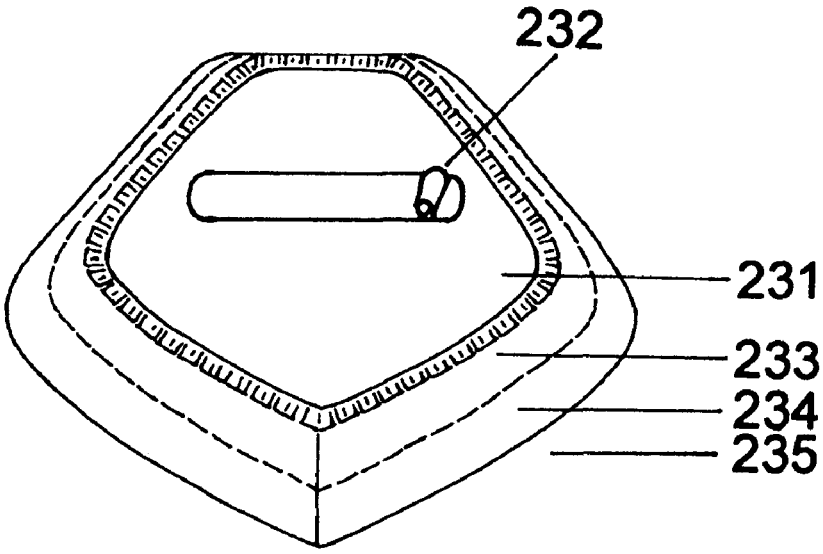

FIG. 4B depicts another embodiment of the present invention. In FIG. 4B, the underside of a nose cover 231 that contains a heat or cold pack is illustrated. The nose cover 231 contains a hot or cold pack that can be used to comfort the user in harsh weather. In FIG. 4B, the hot or cold pack is embedded inside or attached to the nose cover 231. Nose cover 231 has an adhesive strip 232 on its underside. The adhesive strip 232 allows for the user to adhere the nose cover 231 to his nose. The nose cover 231 size can be selected by the user by tearing perforation 233, 234, or 235 for a small sized nose cover 231, a medium sized nose cover 231, or a large sized nose cover 231, respectively.

In another embodiment, the nose cover can be covered by a stretch fabric. The stretch fabric can be stretched around the nose cover. This stretch fabric can have an opening that will allow for packets to be inserted inside. Various types of packets can be used, such as heat packs, cold packs, scented packs, menthol packs, electronic music packs, miniature light bulbs (e.g., light emitting diodes (LEDs)) packs, and radio transmitter and/or receiver packs.

FIG. 4B depicts another embodiment of the present invention. In FIG. 4A, the underside of a nose cover 230 that has a silicone adhesive is illustrated. The nose cover 230 has a silicone adhesive that allows for the nose cover to be adhered to the user's nose. The silicone adhesive also has the characteristic of cooling the user's nose. Paper lining 236 is to be lifted by the user in order to expose the silicone adhesive. The nose cover 230 size can be selected by the user by tearing perforation 237, 238, or 239 for a small sized nose cover 230, a medium sized nose cover 230, or a large sized nose cover 230, respectively.

Figure 5:
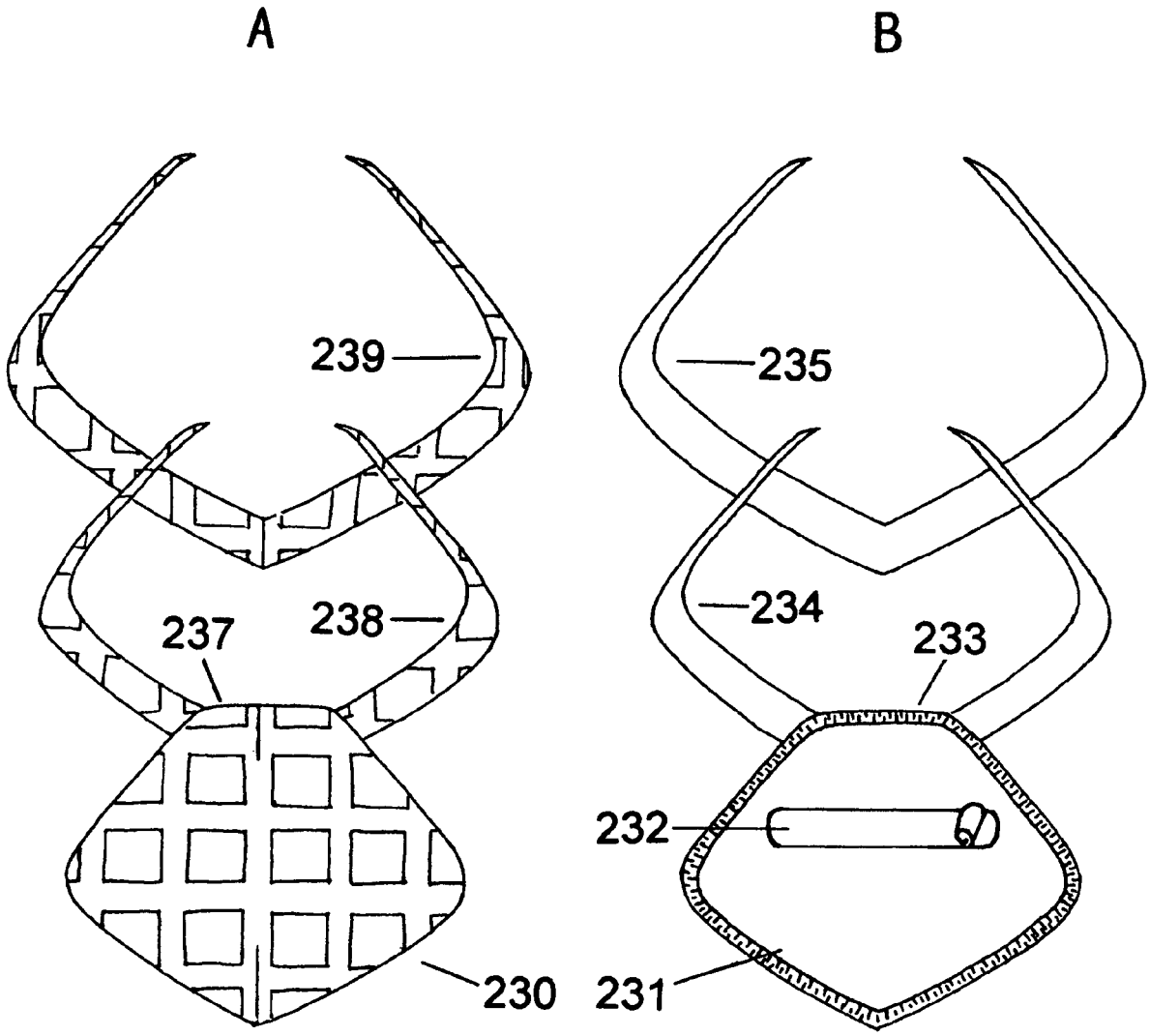
FIG. 5A illustrates an exploded view of FIG. 4A.
FIG. 5B illustrates an exploded view of FIG. 4B.

FIGS. 5A and 5B depict exploded views of FIGS. 4A and 4B, respectively.

Figure 6:
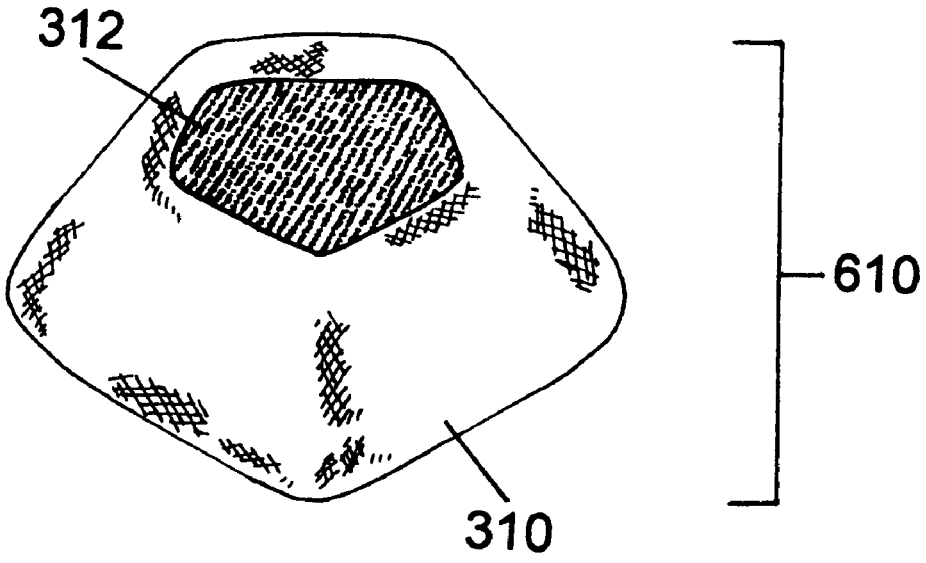
FIG. 6 illustrates the top and side view of a nose cover with a metal patch embedded inside it.
Figure 6:
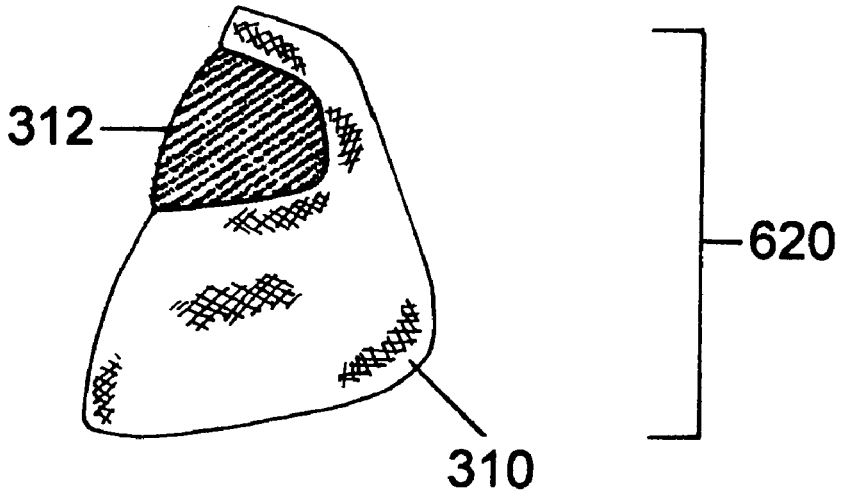

FIG. 6 depicts a top and side view of a nose cover 310 with a metal patch embedded inside it. In FIG. 6, illustration 610 shows a top view of a nose cover 310. A side view of a nose cover 310 is depicted in illustration 620.

Figure 7:
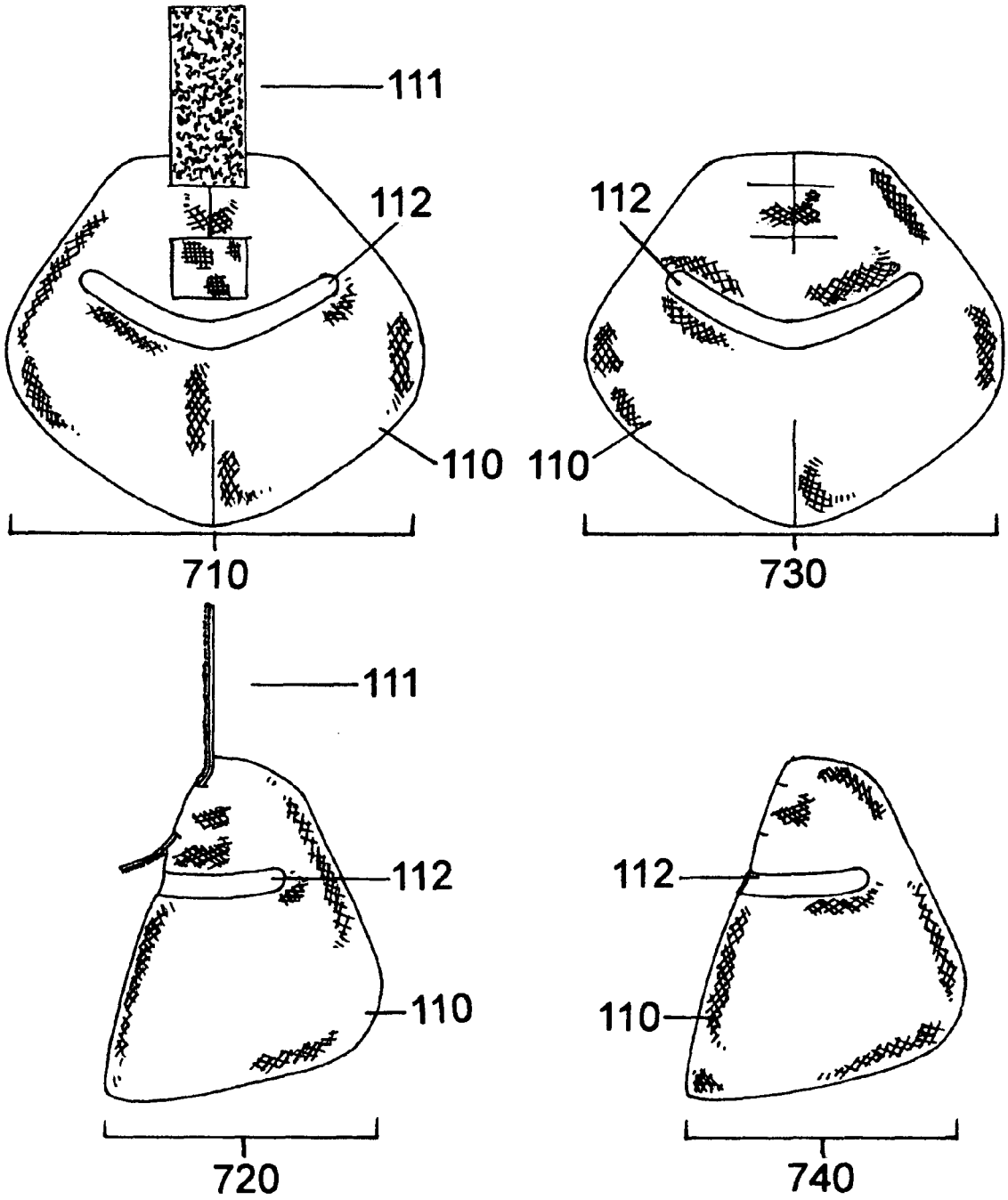
FIG. 7A illustrates the top and side view of a nose cover with a removable strap.
FIG. 7B illustrates the top and side view of a nose cover.

FIG. 7A illustrates the top and side views of a nose cover 110 with removable strap 111. In FIG. 7A, illustration 710 shows a top view of a nose cover 110 with a removable strap 111. A side view of a nose cover 110 with a removable strap 111 is depicted in illustration 720.

FIG. 7B illustrates the top and side views of a nose cover 110 with the removable strap 111 removed. In FIG. 7B, illustration 730 shows a top view of a nose cover 110 without the removable strap 111. A side view of a nose cover 110 without a removable strap 111 is depicted in illustration 740.

Figure 8:
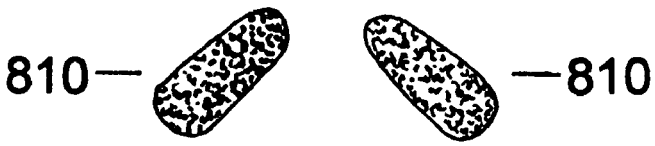
FIG. 8A illustrates two "hook and loop" nose pads.
FIG. 8B illustrates a nose cover with a "hook and loop" patch being attached to eyeglasses.
Figure 8:
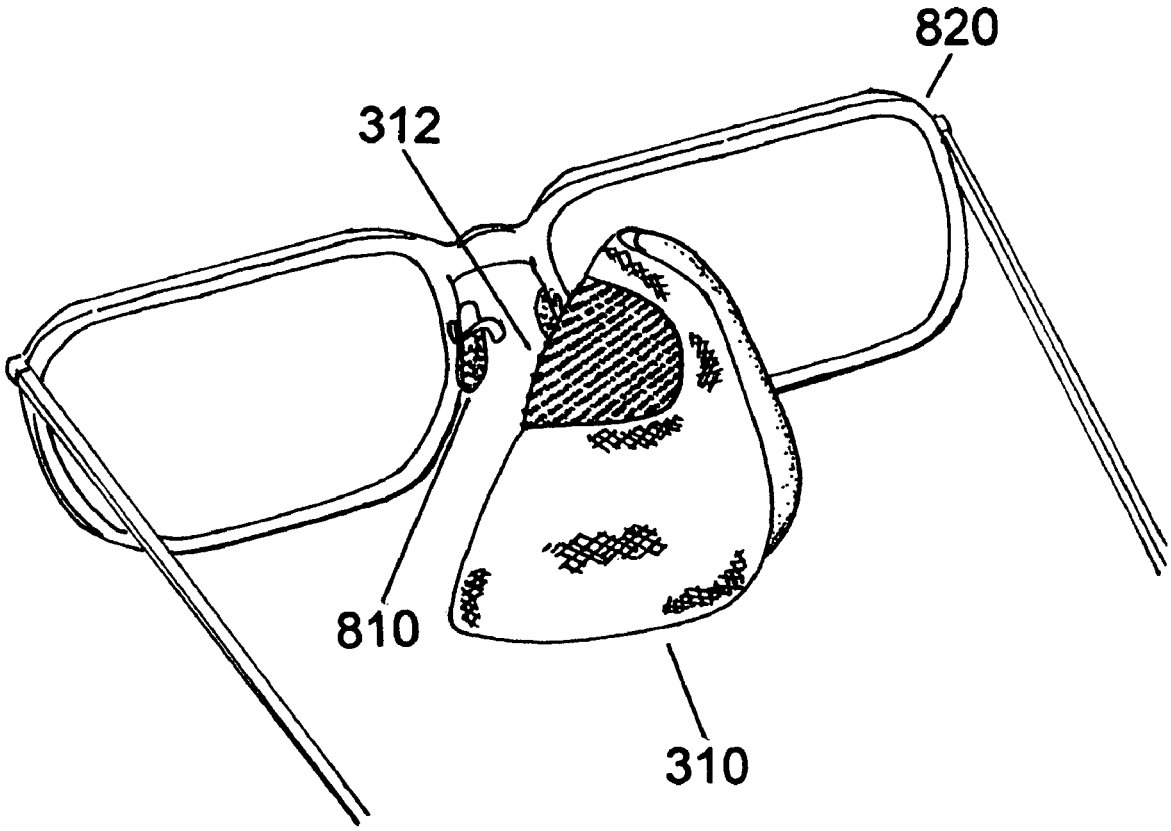

FIGS. 8A and 8B illustrate another embodiment of the present invention. In this embodiment, nose cover 310 that has a metal patch embedded inside is attached to glasses 820 via "hook and loop" (i.e., velcro) material. FIG. 8A depicts two nose pads fabricated out of "loop" material. While, FIG. 8B illustrates a nose cover 310 being attached to glasses 820. In FIG. 8B, the nose cover patch 312 is fabricated out of "hook" material. The nose cover 310 is attached to the glasses 820 by attaching the "hook" material of the nose cover patch to the "loop" material of the nose pads.

Figure 9:
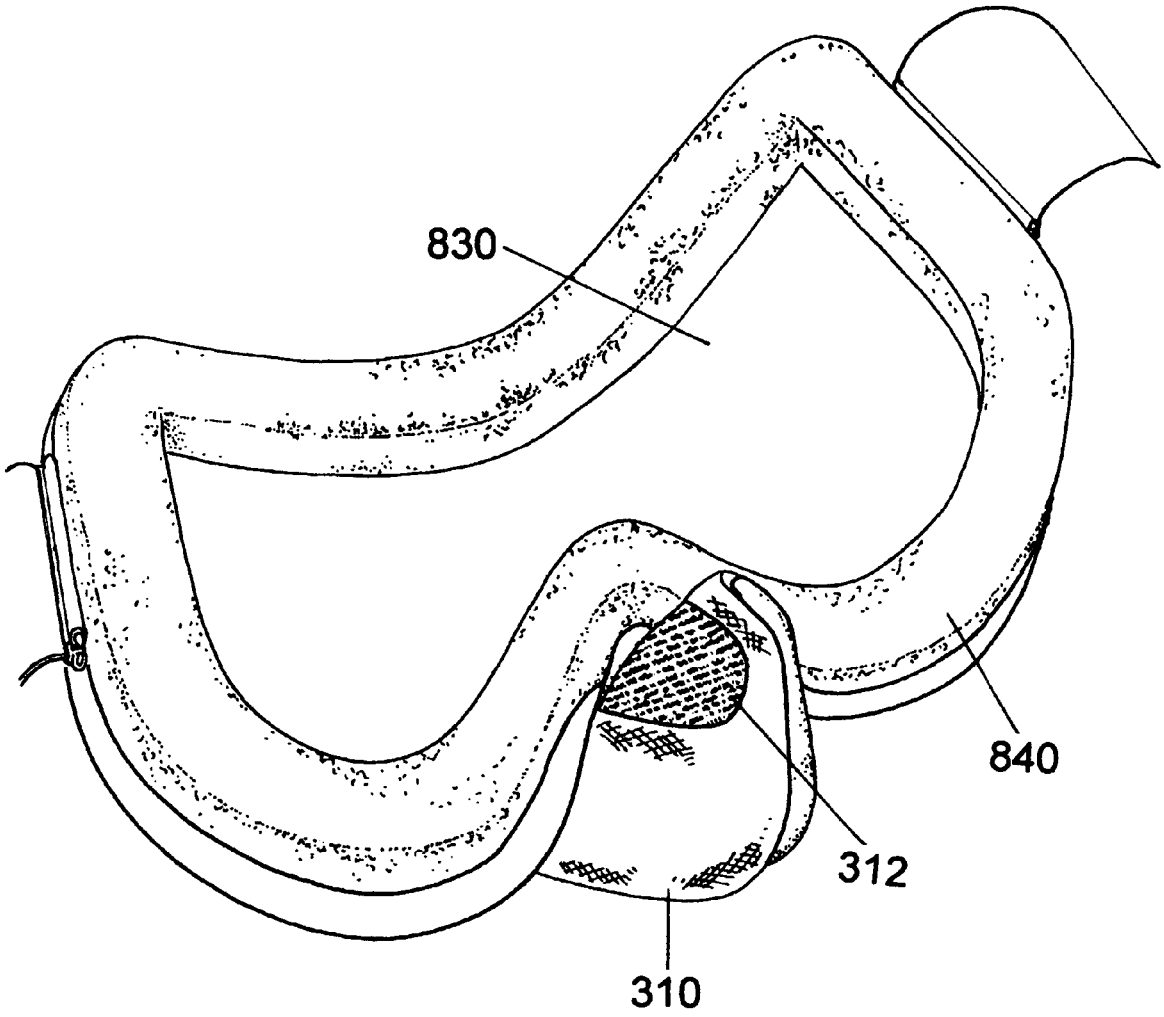
FIG. 9 illustrates a nose cover with a "hook and loop" patch being attached to goggles.

FIG. 9 illustrates another embodiment of the present invention. In this embodiment, nose cover 310 that has a metal patch embedded inside is attached to goggles 830 via "hook and loop" (i.e. velcro) material. In FIG. 9, a nose cover 310 being attached to goggles 830 is illustrated. FIG. 9 shows a nose cover patch 312 that is fabricated out of "hook" material. In FIG. 9, the googles' 830 foam rim 840 consists of foam that is laminated with "hook and loop" compatible materials. The nose cover 310 is attached to the googles 830 by attaching the "hook" material of the nose cover patch to the "loop" material of the googles foam rim 840.

I claim:

1. A flexible nose cover configured to attach to eyewear and shield the nose from frostbite and sunburn comprising:

a) a flexible, pentagonal-shaped body having a substantially flat top portion configured to wrap around the bridge of the nose and a hyperbolic-shaped bottom portion configured to rest on top of the bridge of the nose;

b) a detachable eyewear-fastening strap having a upper portion having a loop fabric and a lower portion having a hook fabric, the loop and hook fabrics interfacing to form a hook and loop type bond, with said upper portion being longer than said lower portion;

c) the nose cover body further comprising:

a. an outer first layer of fabric having a sun protective factor;

b. a intermediate second layer of foam material;

c. a breathable third layer of material that contacts the nose; and d. the top portion of the nose cover body having two parallel, horizontal slits configured to receive the eyewear-fastening strap.

2. The nose cover of claim 1 wherein a thin strip of pliable metal is affixed to the surface of the outer first layer near the center of the nose cover body, said thin strip of metal allowing the nose cover to conform to the shape of the nose and retain its shape until re-configured.

3. The nose cover of claim 2 wherein the thin strip of pliable metal is a 0.006-inch dead soft aluminum.

4. The nose cover of claim 1 wherein the first outer layer of fabric is a spandex material.

5. The nose cover of claim 1 wherein the third layer is a perforated micro-suede, silicon tape, or fleece material.

6. The nose cover of claim 1 wherein the body is made by thermoforming the first, second, and third layers together and using laser processing to further seal the edges of the body.

7. The nose cover of claim 1 wherein the eyewear-fastening strap is inserted through the two horizontal slits in the nose cover and around the bridge section of a selected piece of eyewear, after which the loop and hook portions of the strap are put in contact to fasten the nose cover to the eyewear.

8. The nose cover of claim 1 wherein the horizontal slits are approximately 0.5-inches in length and the eye-wear fastening strap is approximately 3-inches.

9. The nose cover of claim 1 wherein the outer first layer of fabric is embossed, printed, silkscreened, or sublimated with a logo or design.

* * * * *